US008766743B2

(12) United States Patent
Mohamadi et al.

(10) Patent No.: US 8,766,743 B2
(45) Date of Patent: Jul. 1, 2014

(54) WAFER SCALE SPATIAL POWER COMBINER

(75) Inventors: Farrokh Mohamadi, Irvine, CA (US); Mohsen Zolghadri, Newport Beach, CA (US); Mehran Mokhtari, Thousand Oaks, CA (US)

(73) Assignee: Tialinx, Inc., Irvine, CA (US)

( * ) Notice: Subject to any disclaimer, the term of this patent is extended or adjusted under 35 U.S.C. 154(b) by 329 days.

(21) Appl. No.: 13/176,186

(22) Filed: Jul. 5, 2011

(65) Prior Publication Data

US 2012/0001674 A1 Jan. 5, 2012

Related U.S. Application Data

(60) Provisional application No. 61/361,345, filed on Jul. 2, 2010.

(51) Int. Cl.
*H01P 5/12* (2006.01)

(52) U.S. Cl.
USPC ..... 333/125; 333/137

(58) Field of Classification Search
USPC ..... 333/125, 137
See application file for complete search history.

(56) References Cited

U.S. PATENT DOCUMENTS 5,214,394 A * 5/1993 Wong ..... 330/286

* cited by examiner

*Primary Examiner* — Robert Pascal
*Assistant Examiner* — Kimberly Glenn
(74) *Attorney, Agent, or Firm* — Haynes and Boone, LLP

(57) ABSTRACT

A plurality of power amplifiers are integrated into a semiconductor substrate and coupled to a corresponding first plurality of antennas on an adjacent first microwave substrate. A second microwave substrate carries a second plurality of antennas coupled to a combining network. The second microwave substrate is separated from the first microwave substrate to allow a free space combination of RF energy propagated by the first plurality of antennas.

17 Claims, 4 Drawing Sheets

WAFER SCALE SPATIAL POWER COMBINER

RELATED APPLICATION

This application claims the benefit of U.S. Provisional Application No. 61/361,345, filed Jul. 2, 2010, the contents of which are incorporated by reference in their entirety.

TECHNICAL FIELD

The present invention relates generally to power combining, and more particularly to a spatial power combiner using wafer scale antenna technology.

BACKGROUND

Integrated millimeter wave power amplifiers are typically limited to the hundreds of milliwatt output power range even when formed in wide bandgap (III-V) substrates. If greater output powers are desired, a circuit designer must then combine the output signals from multiple integrated power amplifiers using a suitable power combiner. Common power combiner architectures may be broadly classified into two main categories: 1) waveguide-based power combining; and 2) on-wafer/on-board power combining.

In a waveguide-based approach, a metallic waveguide network produces a power combiner having a low insertion loss since the enclosed metallic waveguides do not have any dielectric loss with the underlying substrate. However, even if MEMS micromachining techniques are used to form the metallic waveguides, design and production of suitable metallic waveguide-based power combiners is expensive and challenging.

A Wilkinson power combiner is an example of an on-board alternative to a waveguide-based architecture and is low cost in comparison to waveguide approaches. However, since the power combiner and divider network is integrated on the same wafer (or in lamination on a circuit board), thermal management is difficult.

Accordingly, there is a need in the art for improved power combiner architectures that provide the cost advantages of on-board solution yet achieve the low loss advantages of a waveguide-based approach.

SUMMARY

In accordance with one aspect of the invention, a spatial power combiner is provided that includes: a semiconductor substrate including a plurality of integrated power amplifiers; a first microwave substrate including a first plurality of antennas fed by the plurality of integrated power amplifiers; a second microwave substrate including a second plurality of antennas and a combining network, wherein the second microwave substrate is separated from the first microwave substrate such that when the plurality of integrated power amplifiers amplify an RF signal, the amplified RF signal is transmitted by the first plurality of antennas to produce a combined RF signal in a separation between the first and second microwave substrates.

In accordance with a second aspect of the invention, a method of combining power is provided that includes: driving an RF signal into a plurality of power amplifiers; within each power amplifier, amplifying the RF signal to provide an amplified RF signal to a corresponding first antenna; from each first antenna, transmitting the amplified RF signal into free space, wherein a resulting combined RF signal propagates in the free space; receiving the resulting combined RF signal at a plurality of second antennas, wherein each second antenna produces a received RF signal; and in a combining network coupled to the plurality of second antennas, combining the received RF signal to produced a combined RF signal.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Reference will now be made in detail to one or more embodiments of the invention. While the invention will be described with respect to these embodiments, it should be understood that the invention is not limited to any particular embodiment. On the contrary, the invention includes alternatives, modifications, and equivalents as may come within the spirit and scope of the appended claims. Furthermore, in the following description, numerous specific details are set forth to provide a thorough understanding of the invention. The invention may be practiced without some or all of these specific details. In other instances, well-known structures and principles of operation have not been described in detail to avoid obscuring the invention.

Figure 1:
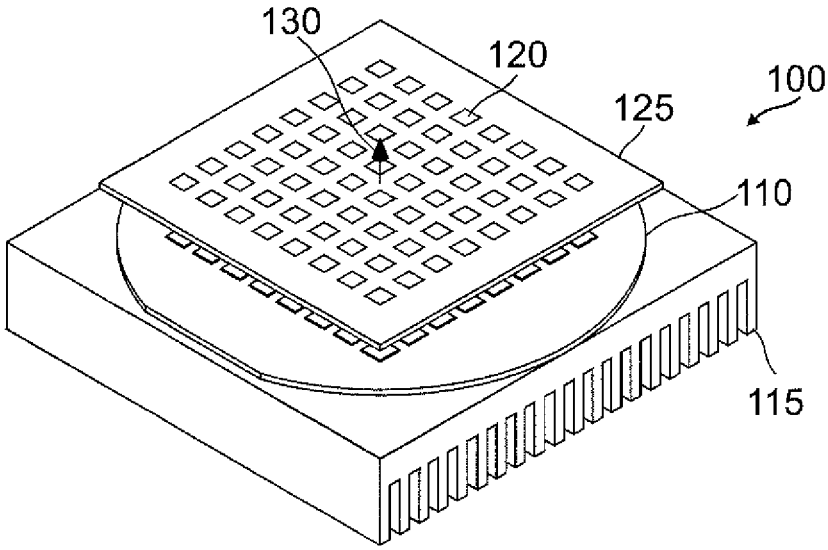
FIG. 1 is an exploded view of an emitter for a spatial power combiner in accordance with an embodiment of the invention.

A spatial power combiner architecture is disclosed that provides the cost advantages of an on-wafer (or on board) approach yet achieves the loss characteristics of a waveguide-based approach. Turning now to the drawings, FIG. 1 shows an emitter side 100 for the spatial power combiner architecture. A planar array of power amplifiers 105 is monolithically integrated onto a wafer such as a GaN (or GaAs) wafer 110. A heat sink 115 couples to a back side of wafer 110 whereas an array of antennas 120 on a high-quality microwave substrate 125 couples to a front side of wafer 110. In that regard, at an output of each power amplifier 105, coupling means such as an array of conducting bumps (such as gold bumps, not illustrated) with fine pitches are patterned and formed to facilitate interconnection to corresponding conductive vias in microwave substrate 125. The conductive vias serve as the input ports for antennas 120. Since each power amplifier 105 directly feeds a corresponding antenna 120, there is no lossy distribution network subsequent to the array of power amplifiers. Instead, all major transmission line loss occurs prior to the power amplifier stage. By adjusting the power amplifier gain setting or inserting an additional gain stage before the power amplifier stage to compensate for the power divider, a maximum output power from each power amplifier may be obtained.

Since all the active circuitry is on the upper surface of wafer 125, heat sink 115 can be attached directly to the wafer backside. In that regard, there is no need for access to the wafer backside, which simplifies heat management issues without affecting power amplifier performance.

Figure 2:
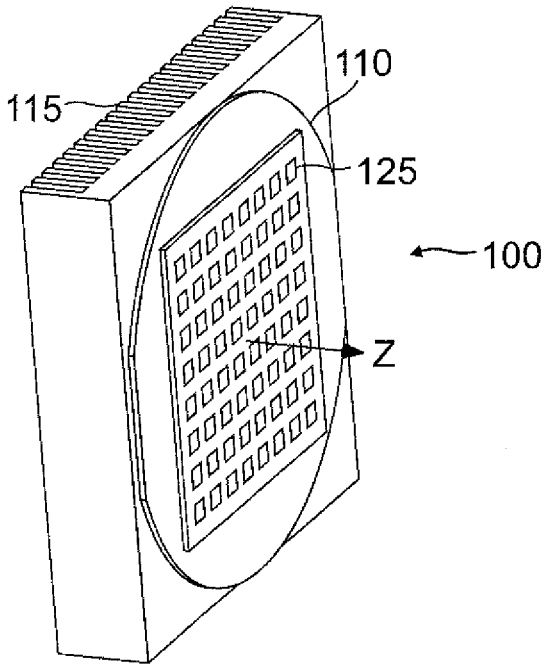
FIG. 2 is a perspective view of the emitter of FIG. 1

FIG. 2 shows emitter 100 with substrate 125 bounded to substrate 110 using a flip-chip process (a wafer-scale flip-chip process). In FIGS. 1 and 2, emitter 100 has sixty-four power amplifiers and corresponding antennas to address the potential yield issues for devices such as GaN devices. In this fashion, a substantial amount of power may be provided in the millimeter bands despite the relatively low power from each power amplifier. In one embodiment, an arrangement of quad cells may be used as sub-arrays, where each sub-array or tile of power amplifiers forms a four by four array.

Figure 3:
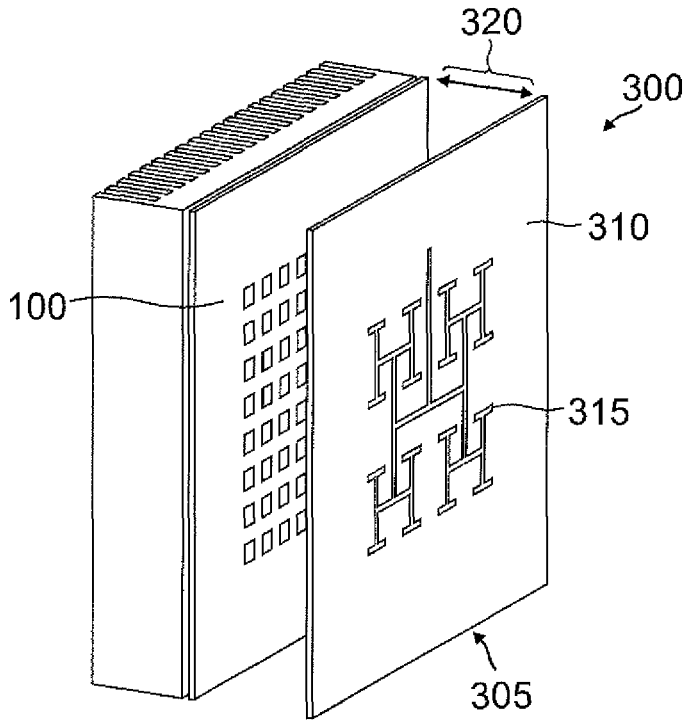
FIG. 3 is a perspective view of a spatial power combiner including the emitter of FIGS. 1 and 2 as well as a collector.
Figure 4:
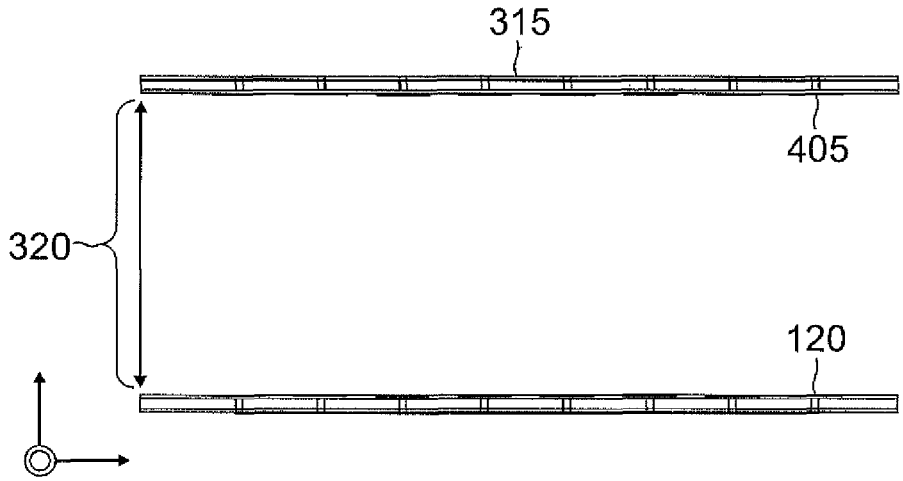
FIG. 4 is a cross-sectional view of the spatial power combiner of FIG. 3.

FIG. 3 shows a resulting spatial power combiner 300 using emitter 100 of FIGS. 1 and 2. The array of antennas 120 from emitter 100 form a high-gain narrow beam that propagates to a collector 305. Note that the power combining from antennas 120 occurs in free space so there is no significant substrate loss as would occur in an on-board approach. Yet combiner 300 is readily manufactured using conventional semiconductor foundry or circuit board processes without the heat management issues of on-board or on-wafer approaches. Collector 305 is formed on an extremely low-loss substrate 310 such as Teflon. As shown in cross section in FIG. 4, collector 305 includes an array of receiving antennas 405. A combining network 315 is formed on an opposing surface of substrate 310. Combining network 315 may be formed using microstrip or strip lines. An RF distribution network (not illustrated) that provides an RF input signal to the array of power amplifiers on the emitter may be constructed analogously. Alternatively, combining network 315 may be formed using metallic waveguides. A magnitude for a separation distance 320 between emitter 100 and collector 305 determines whether the free-space electromagnetic propagation from emitter 100 to collector 305 is in the near-field or in the far-field. Regardless of the near-field or far-field nature of the resulting power combiner, the planar antenna arrays are arranged in parallel facing each other for maximum power coupling.

An analytical study of the resulting combiner discussed further below using the Friis equation assumes the far-field condition. However, for a large array with a resulting large aperture size, the separation between the two arrays might be too large for a compact design. Thus, near-field combining is also suitable in some embodiments of the disclosed spatial combiner. Simulation results for an 8 by 8 antenna array show that the wave fronts are virtually planar and propagate in the z direction as indicated by arrow 130 in FIG. 1.

Figure 5:
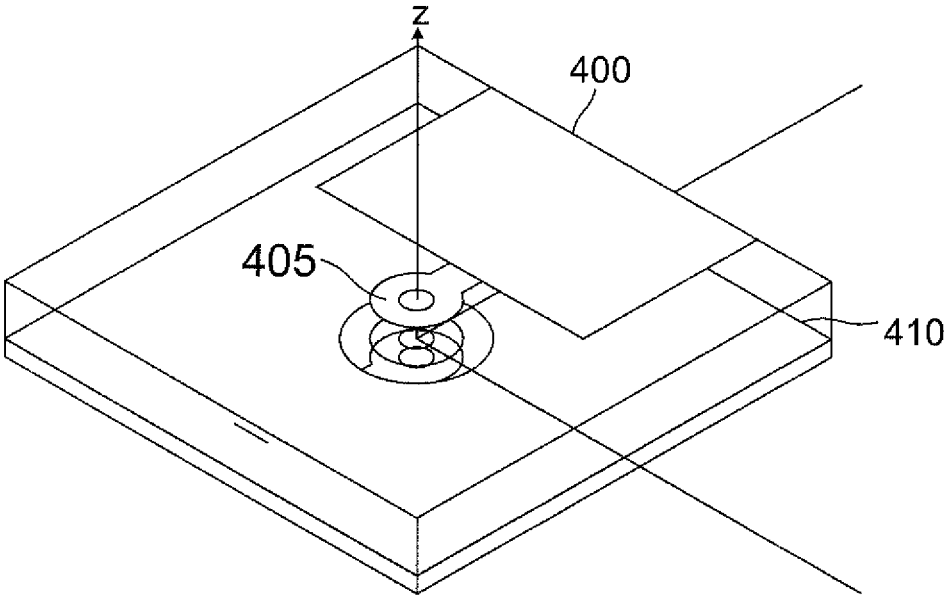
FIG. 5 is a perspective view of a patch antenna for the power combiner of FIG. 3.

FIG. 5 shows a patch antenna suitable for implementation in either emitter 100 or collector 305. Patch 400 is fed by an L-shaped proximity probe 405 for broadband performance. However, it will be appreciated that other feed structures such as aperture coupling or a probe feed may be used. Moreover, other antenna topologies such as dipole antennas may be used in lieu of a patch structure. Probe 405 extends through an opening in a ground plane 410 to couple to the interconnection (not shown) to a power amplifier should patch 400 be used in emitter 100. Alternatively, probe 405 couples to combining network 315 should patch 400 be used in collector 305.

Simulation results using the antenna design of FIG. 5 for an 8 by 8 emitting and receiving array show that at a separation distance of 5 mm, there is some near-field-caused increase reflection between 65 GHz and 72 GHz. However, even at this separation, there is an insertion loss of just 2.1 dB between 72 GHz and 77 GHz. In contrast, with the separation doubled to 10 mm, the insertion loss is just 2.5 dB while the reflection between 65 GHz and 72 GHz becomes less. Finally, as the separation is increased to 20 mm, the reflection between 71 GHz and 76 GHz is within a desired 10 dB zone with an insertion loss of just 3 dB.

If each power amplifier provides just 200 milliwatts, more than just sixty-four amplifiers will have to be combined to achieve relatively high powers such as 40 watts. Thus, simulation results were also obtained for a 16 by 16 array of transmitting and receiving antennas. In that regard, a full-wave simulation shows a combining gain of 30 dB and, as would be expected, a significantly narrower beam than as compared to an 8 by 8 antenna array embodiment. With a 5 mm plate separation, a 16 by 16 array simulation shows that there is more reflections in the millimeter wave band of interest with no significant improvement on the insertion loss. Similarly, simulation results for a 10 mm and also a 20 mm separation shows no major improvement over an 8 by 8 antenna array design, likely due to continued near-field interactions. However, it is believed that as the separation is increased for a larger array, there should be less loss because of the larger aperture.

Spatial combining provides superior performance in terms of small signal linearity for each power amplifier, uniformly distributed power over the entire available substrate, and a superbly compact design—for example; a 4 cm by 4 cm substrate size for a 16×16 element array with a plate separation of just 1 cm. With a power amplifier output of 200 mW, a 16×16 spatial combiner provides 40 watts of combined power in such a compact package. If each power amplifier is rated at 800 mW of power, an 8 by 8 element array could also provide 40 watts of combined power. This is quite advantageous in that achieving such a power using conventional waveguide-based or on-board approaches would be quite expensive and difficult.

Figure 6:
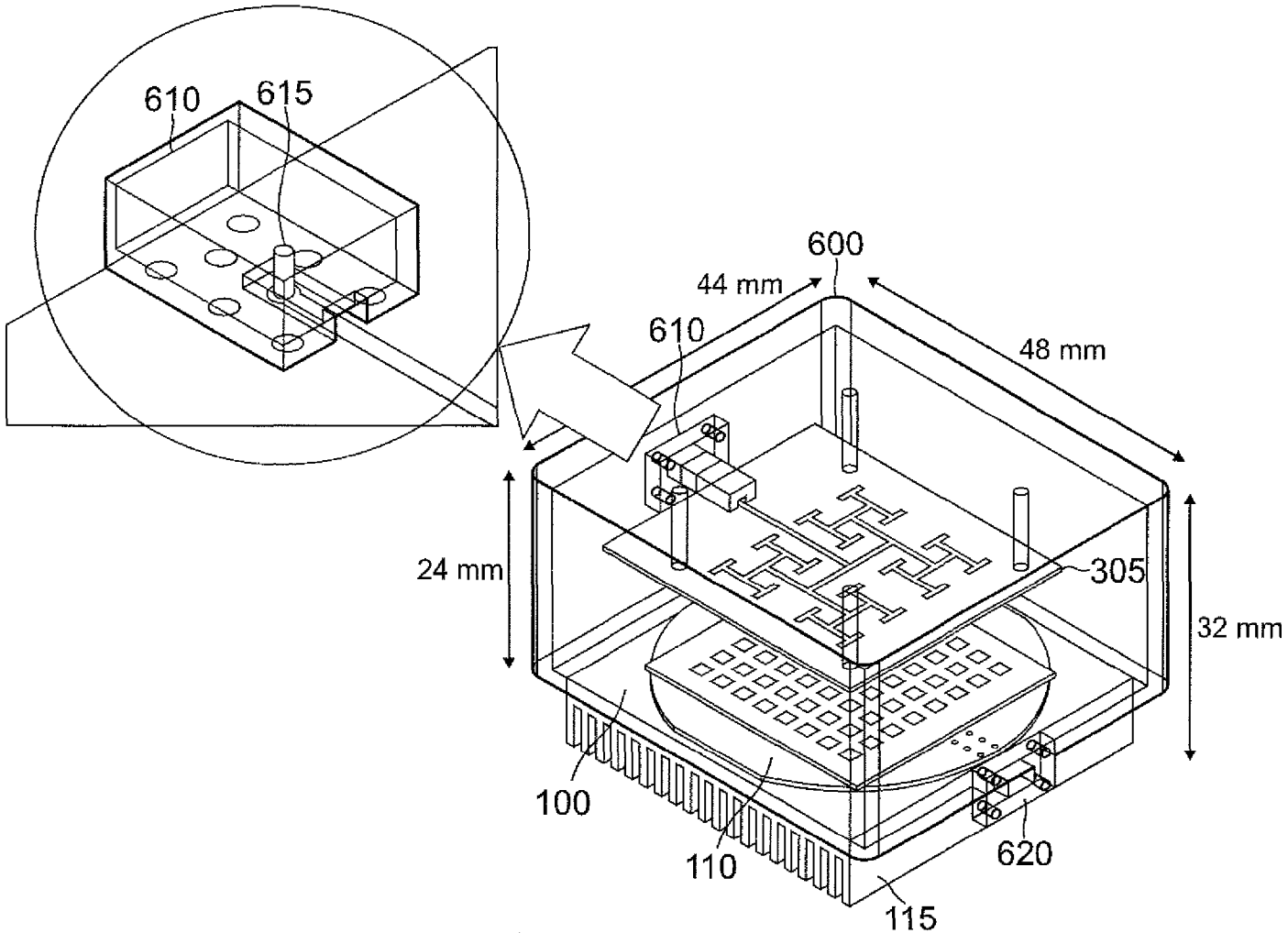
FIG. 6 is a perspective view of a spatial power combiner including a waveguide enclosure as well as an enlarged view of a waveguide output coupling.

Should emitter 100 and collector 305 merely be separated in free space without any sort of enclosure, radiation losses may be quite high. To markedly increase efficiency, a grounded metallic waveguide enclosure 600 surrounds both elements as shown in FIG. 6. For example, in a 65 GHz to 77 GHz embodiment, waveguide enclosure 600 may be a rectangular waveguide having a height of 24 mm, a length of 48 mm, and a width of 44 mm. In a W-band embodiment, the waveguide enclosure dimensions may be modified accordingly. It may be seen that emitter 100 thus acts an exciter within enclosure 600 to excite a planar wave propagation towards collector 305. Substrate 110 may be mounted onto a lower inner surface for waveguide enclosure 600. Heat sink 115 would thus be affixed to a corresponding outer lower surface of enclosure 600. The resulting dimensions for the power combiner including the heat sink has a height of merely 32 mm. Collector 305 may be suspended from an upper inner surface of enclosure 600 using supports 605. The length of supports 605 controls a resulting separation between emitter 100 and collector 305. Combining network 315 couples to a waveguide output port 610 through an exciter probe 615 as seen in the enlarged view. A similar waveguide input port 620 couples to the RF distribution network feeding the array of power amplifiers.

It will be obvious to those skilled in the art that various changes and modifications may be made without departing from this invention in its broader aspects. For example, the disclosed power combiner is readily applied to W-band embodiments. The appended claims encompass all such changes and modifications as fall within the true spirit and scope of this invention.

We claim:

1. A spatial power combiner, comprising:

a semiconductor substrate including a plurality of integrated power amplifiers;

a first microwave substrate including a first plurality of antennas fed by the plurality of integrated power amplifiers;

a second microwave substrate including a second plurality of antennas and a combining network, wherein the second microwave substrate is separated from the first microwave substrate by a separation of at least 5 mm such that when the plurality of integrated power amplifiers amplify an RF signal, the amplified RF signal is transmitted by the first plurality of antennas to produce a combined RF signal in the separation between the first and second microwave substrates.

2. The spatial power combiner of claim 1, wherein the separation is at least 10 mm.

3. The spatial power combiner of claim 1, wherein the semiconductor substrate is a GaN substrate.

4. The spatial power combiner of claim 1, wherein the semiconductor substrate is a GaAs substrate.

5. The spatial power combiner of claim 1, wherein the semiconductor substrate, the first microwave substrate, and the second microwave substrate are all enclosed in a metallic waveguide enclosure.

6. The spatial power combiner of claim 1, wherein the plurality of power amplifiers is a 16×16 array of 200 mW power amplifiers, and wherein the combined RF signal from the combining network is a 40 W signal.

7. The spatial power combiner of claim 6, wherein the 40 W signal has a frequency between 65 GHz and 77 GHz.

8. The spatial power combiner of claim 1, wherein the plurality of power amplifiers is an 8×8 array of 800 mW power amplifiers, and wherein the combined RF signal from the combining network is a 40 W signal.

9. The spatial power combiner of claim 8, wherein the 40 W signal has a frequency between 65 GHz and 77 GHz.

10. The spatial power combiner of claim 1, further comprising a metallic waveguide enclosure surrounding the first and second microwave substrates.

11. The spatial power combiner of claim 10, wherein the first and second plurality of antennas are patch antennas.

12. The spatial power combiner of claim 11, wherein the patch antennas are L-shaped proximity coupled patch antennas.

13. A method of combining power, comprising:

driving an RF signal into a plurality of power amplifiers;

within each of the power amplifier, amplifying the RF signal to provide an amplified RF signal to a corresponding first antenna in an array of first antennas;

from each of the first antennas, transmitting the amplified RF signal into free space separating the first array of antennas from a second array of antennas by a separation of at least 5 mm, wherein a resulting combined RF signal propagates in the free space;

receiving the resulting combined RF signal at a the plurality of second antennas, wherein each second antenna produces a received RF signal; and in a combining network coupled to the plurality of second antennas, combining the received RF signal to produce a combined RF signal.

14. The method of claim 13, wherein the RF signal has a frequency between 65 GHz and 77 GHz.

15. The method of claim 13, wherein the RF signal has a frequency greater than 65 GHz.

16. The method of claim 13, wherein the separation is at least 10 mm.

17. The method of claim 13, wherein the separation is greater than 10 mm.

* * * * *